US005304079A

United States Patent [19]

Karls

[11] Patent Number: 5,304,079

[45] Date of Patent: Apr. 19, 1994

[54] SUPPLEMENTAL REMOTE MOUNTED MARINE ENGINE COOLING SYSTEM

[75] Inventor: Michael A. Karls, Hilbert, Wis.

[73] Assignee: Brunswick Corporation, Skokie, Ill.

[21] Appl. No.: 63,004

[22] Filed: May 17, 1993

[51] Int. Cl.[5] ..... B63H 21/10

[52] U.S. Cl. ..... 440/88; 123/41.15

[58] Field of Search ..... 440/88, 89; 114/198, 114/255; 123/41.02, 41.05, 41.08, 41.15, 41.29, 41.44

[56] References Cited

U.S. PATENT DOCUMENTS

| | | | |
|---|---|---|---|
| 3,323,502 | 6/1967 | Whalen | 123/41.08 |
| 4,636,175 | 1/1987 | Frazzell et al. | 440/88 |
| 4,728,306 | 3/1988 | Schneider | 440/88 |
| 4,752,257 | 6/1988 | Karls et al. | 440/88 |
| 4,767,366 | 8/1988 | Lang | 440/88 |
| 5,045,001 | 9/1991 | Borst | 440/88 |

FOREIGN PATENT DOCUMENTS

| | | | |
|---|---|---|---|
| 663662 | 5/1964 | Italy | 440/38 |

*Primary Examiner*—Jesus D. Sotelo
*Attorney, Agent, or Firm*—Andrus, Sceales, Starke & Sawall

[57] ABSTRACT

A supplemental remote mounted marine engine cooling system (20) includes a supplemental water pickup (36) mounted to the boat (18), and a flow control valve (38) supplying supplemental cooling water therethrough from the water pickup (36) to the main cooling system (20) when main cooling system water pressure on the downstream side (48) of a check valve (44) in the flow control valve (38) is less than supplemental cooling system water pressure on the upstream side (46) of the check valve (44), and blocking supplemental water flow therethrough when main cooling system water pressure is greater than supplemental cooling system water pressure. The control valve (38) also includes a relief valve (50) between the check valve (44) and the water pickup (36) and discharging excess supplemental cooling water when the check valve (44) is blocking water flow therethrough and supplemental cooling system water pressure is above a given bypass relief threshold. The control valve (38) provides continuous flow therethrough to a first outlet having the check valve (44) and/or a second bypass outlet having the relief valve (50), at high boat speed, to minimize deadhead pressure and minimize reduction in top end boat speed otherwise resulting from the addition of a supplemental water pickup. The water pickup (36) is provided by a tube (106) slicing out a core of water along the underside of the boat hull (108) with minimal drag and turbulence.

25 Claims, 3 Drawing Sheets

FIG. 1
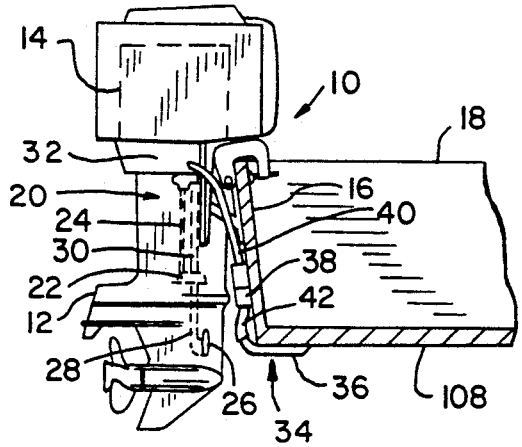
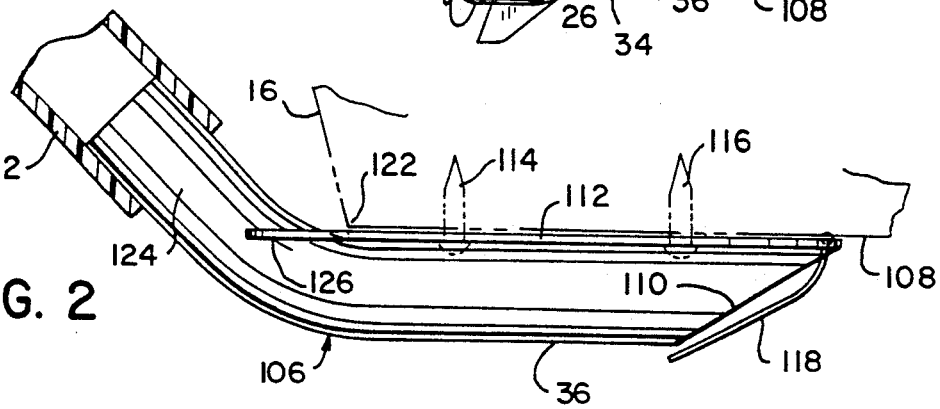
FIG. 2
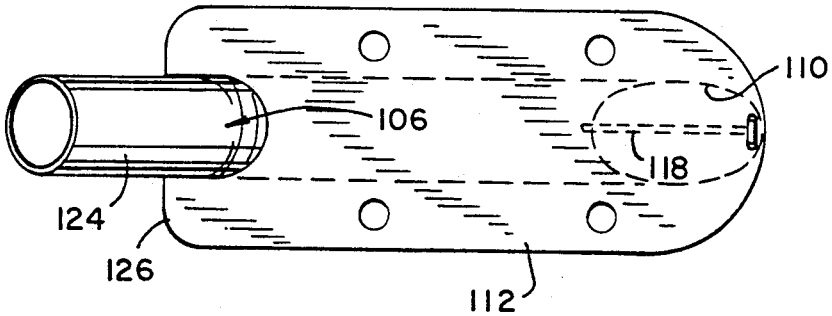
FIG. 3
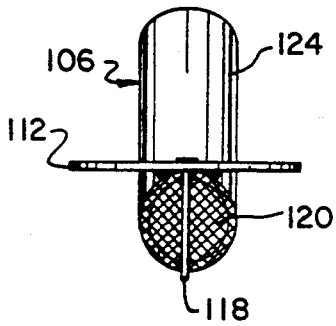
FIG. 4

FIG. 7
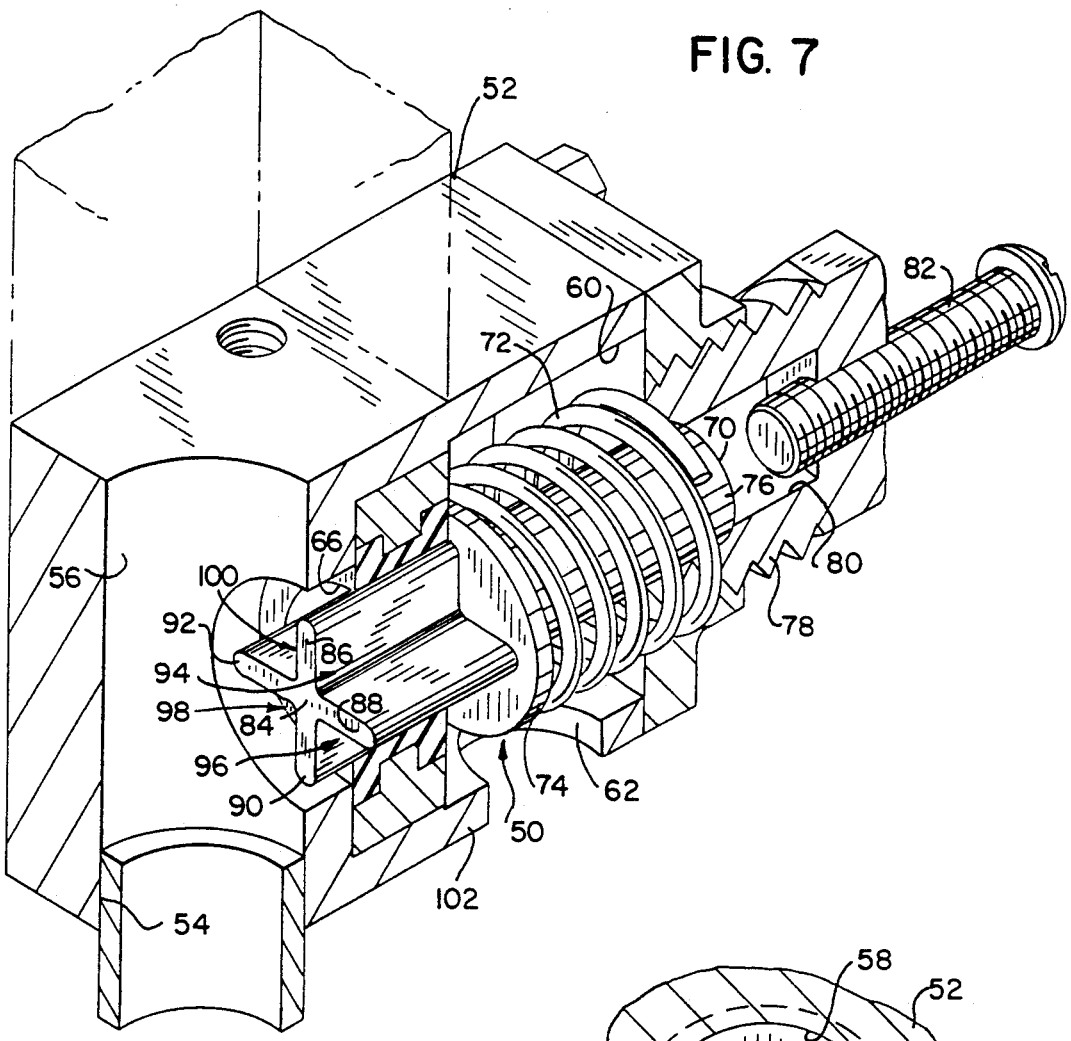
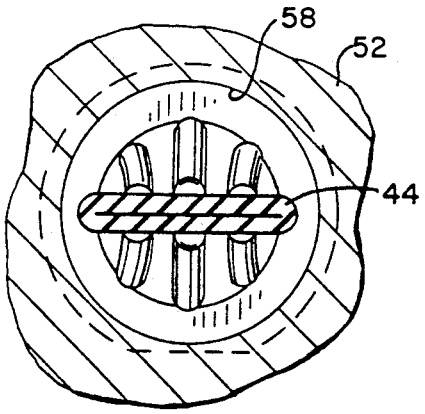
FIG. 8

SUPPLEMENTAL REMOTE MOUNTED MARINE ENGINE COOLING SYSTEM

BACKGROUND AND SUMMARY

The invention relates to marine engine cooling systems, and more particularly to a supplemental cooling system and water pickup therefor.

A marine engine has a main cooling system including gearcase water inlets supplying cooling water to the engine. A shaft-driven pump in the gearcase pumps cooling water from the inlets upwardly to the engine. At high boat speed, the pump may not be able to deliver enough cooling water to the engine and/or the gearcase water inlets may be above or partially above the waterline or otherwise aerated when the boat is on plane.

The present invention provides a supplemental cooling system supplying supplemental cooling water to the main cooling system to provide additional cooling for the engine, particularly at high boat speed.

In one aspect of the invention, a low drag water pickup is provided, minimizing boat drag otherwise caused by an additional water pickup. This in turn minimizes the reduction in top end boat speed.

In another aspect of the invention, a flow control valve is provided which includes a check valve between the main cooling system and the supplemental water pickup and supplying supplemental cooling water therethrough when main cooling system water pressure on the downstream side of the check valve is less than supplemental cooling system water pressure on the upstream side of the check valve, and blocking supplemental water flow therethrough from the supplemental water pickup to the main cooling system when main cooling system water pressure on the downstream side of the check valve is greater than supplemental cooling system water pressure on the upstream side of the check valve.

In another aspect of the invention, a continuous flow control valve is provided and enables continuous water flow therethrough to either the main cooling system or to a bypass relief outlet at high boat speed, to minimize deadhead pressure and boat drag. The flow control valve includes a relief valve between the check valve and the supplemental water pickup and discharges excess supplemental cooling water from the water pickup when the check valve is blocking water flow therethrough and supplemental cooling system water pressure is above a given relief threshold.

BRIEF DESCRIPTION OF THE DRAWINGS

FIG. 1 is a side view of a marine drive and illustrates a supplemental remote mounted marine engine cooling system in accordance with the invention.

FIG. 2 is an enlarged view of a portion of the cooling system of FIG. 1.

FIG. 3 is a top view of the structure of FIG. 2.

FIG. 4 is an end view of the structure of FIG. 3.

FIG. 7 is a perspective view of a portion of the structure of FIG. 5.

FIG. 8 is sectional view taken along line 8—8 of FIG. 5.

DETAILED DESCRIPTION

Figure 5:
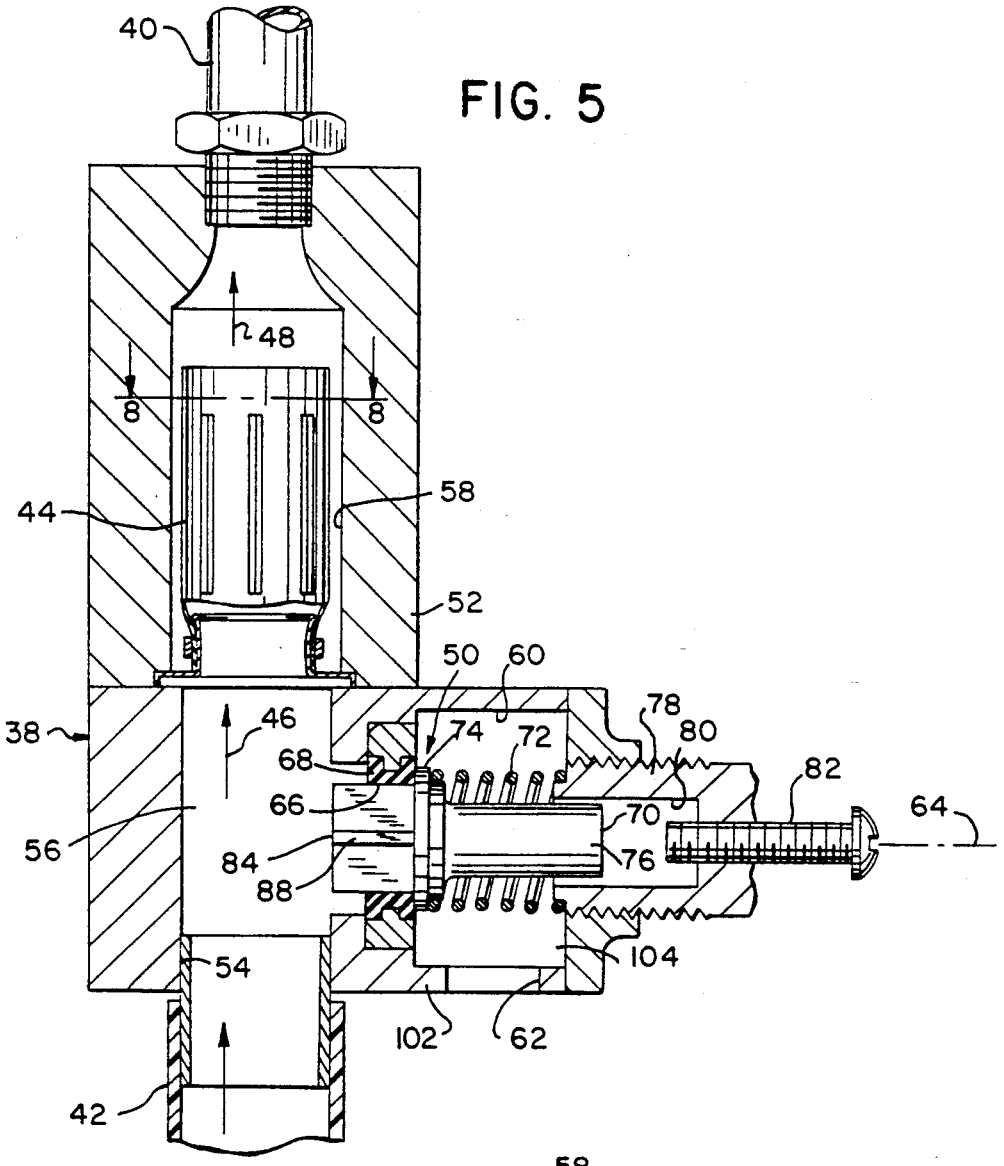
FIG. 5 is an enlarged sectional view of a portion of the structure of FIG. 1.

FIG. 1 shows a marine drive 10 including an outboard drive unit 12 having a power head with a marine engine 14 and mounted on the transom 16 of a boat 18. The engine has a main cooling system 20 including a water pump 22 driven by driveshaft 24 and pumping cooling water from gearcase water inlets 26 through water passage 28 up to pump 22 and then upwardly through water passage 30 to adaptor plate 32 for supply to the engine cooling passages, all as is conventional.

The present invention provides a supplemental remote mounted cooling system 34 including a supplemental water pickup 36 mounted to boat 18 for supplying supplemental cooling water to main cooling system 20. A flow control valve 38 is provided between main cooling system 20 and supplemental water pickup 36 and is connected thereto by respective connection hoses 40 and 42. Flow control valve 38 includes a check valve 44, FIG. 5, preferably a duck-bill valve, having an upstream side 46 communicating with water pickup 36, and a downstream side 48 communicating with main cooling system 20, preferably at adaptor plate 32 downstream of pump 22, or in an alternate embodiment upstream of pump 22 at passage 28. Check valve 44 supplies supplemental cooling water therethrough from water pickup 36 to main cooling system 20 to provide additional cooling for engine 14 when main cooling system water pressure on downstream side 48 of check valve 44 is less than supplemental cooling system water pressure on upstream side 46 of check valve 44. This is particularly desirable at high boat speed where pump 22 may not be capable of supplying sufficient cooling water to the engine. The supplemental cooling water is provided by dynamic or ram pressure through pickup 36, without an additional pump. Water pickup 36 is independent and remote from gearcase water inlets 26 and can supply supplemental cooling water even if gearcase water inlets 26 are partially above the water line and/or are aerated at high boat speed. Check valve 44 blocks supplemental water flow therethrough from pickup 36 to main cooling system 20 when main cooling water pressure on downstream side 48 of check valve 44 is greater than supplemental cooling system water pressure on upstream side 46 of check valve 44. This occurs when pump 22 is supplying sufficient cooling water flow and pressure for engine 14, and hence supplemental cooling water is not needed.

Flow control valve 38 further includes a relief valve 50 between check valve 44 and water pickup 36. Relief valve 50 discharges excess supplemental cooling water from the water pickup when check valve 44 is blocking supplemental water flow therethrough and supplemental cooling system water pressure is above a given relief threshold. Relief valve 50 is a spring loaded member having a closed condition, FIG. 5, when supplemental cooling system water pressure is below the given relief threshold, and having an open position, FIG. 6, when supplemental cooling system water pressure is above the given relief threshold. Relief valve 50 in the open condition diverts supplemental cooling water therethrough and away from check valve 44. Relief valve 50 in the closed condition blocks supplemental cooling water flow therethrough and diverts supplemental cooling water to check valve 44.

Figure 6:
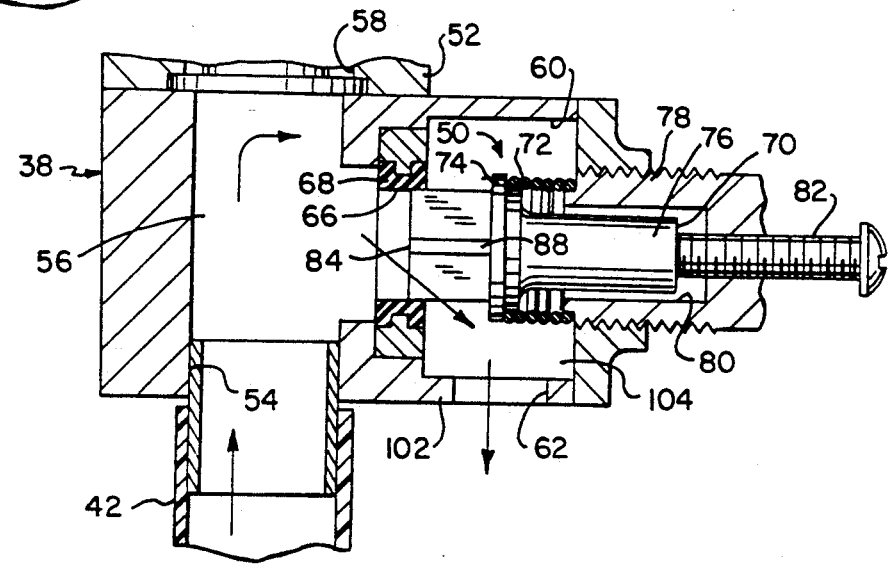
FIG. 6 is a view of a portion of the structure of FIG. 5 and illustrates another operating condition thereof.

The flow control valve includes a housing 52, FIGS. 5–7, having a first passage 54 leading to a chamber 56 and receiving water from water pickup 36. The housing includes a second passage 58 having check valve 44 therein and leading from chamber 56 and supplying supplemental cooling water to main cooling system 20. The housing includes a third passage 60 having relief valve 50 therein and leading from chamber 56 and supplying excess supplemental cooling water to a discharge port 62 for discharge to ambient.

Passage 60 in housing 52 extends along an axis 64 from chamber 56 and has an entrance port 66 at the chamber at sealing grommet 68. Passage 60 has an exit port provided by discharge port 62. A plunger 70 is axially reciprocal in passage 60 along the noted axis 64, and has an open position, FIG. 6, opening entrance port 66, and a closed position, FIG. 5, closing entrance port 66. A biasing member is provided by helical compression spring 72 axially biasing plunger 70 to the closed position, FIG. 5. Plunger 70 moves axially rightwardly to the open position in FIG. 6 when the differential pressure between chamber 56 and discharge port 62 across plunger 70 at entrance port 66 overcomes the bias of spring 72.

Plunger 70 has a central flange providing a plunger head 74 engaging entrance port 66 in the closed position, FIG. 5. The plunger includes a shank portion 76 extending axially rightwardly from plunger head 74. Helical compression spring 72 encircles shank portion 76 and bears against plunger head 74. The valve housing includes a threaded adjustment member 78 in passage 60 and axially spaced from plunger head 74. Spring 72 bears between adjustment member 78 and plunger head 74. Adjustment member 78 is threadingly moveable by the user axially toward and away from entrance port 66 to adjust the bias of spring 72 to adjust the noted relief threshold to vary the amount of differential pressure required to axially move plunger 70 to the open condition, FIG. 6, to permit water flow from chamber 56 through passage 60 to discharge port 62. Adjustment member 78 includes an internal axially extending guide passage 80 receiving plunger shank portion 76. Adjustment member 78 has a threaded bolt 82 extending axially through the end thereof and providing a stop for rightward movement of the plunger to the open position, FIG. 6.

Plunger 70 includes guide structure 84, FIG. 7, extending axially leftwardly from plunger head 74 through entrance port 66 in each of the open and closed positions of plunger 70. Guide structure 84 has an X-shape in end view, FIG. 7, having four radial struts 86, 88, 90, 92, defining quadrants therebetween providing four flow channels 94, 96, 98, 100. When plunger 70 is in the open position, FIG. 6, water flows from chamber 56 through channels 94, 96, 98, 100, FIG. 7, through entrance port 66 and into passage 60. As plunger 70 moves between the open and closed positions, struts 86, 88, 90, 92 slide axially along and through entrance port 66 and guide reciprocal movement of plunger 70. Passage 60 has a sidewall 102 extending parallel to axis 64 and spaced laterally outwardly of plunger 70 by an annular gap 104 therebetween. Discharge port 62 is in sidewall 102.

The user adjustable loading mechanism provided by adjustment member 78 changes the bias on spring loaded plunger 70 to vary the noted relief threshold, to in turn vary boat drag. The lower the relief threshold, the lower the boat drag. Control valve 38 provides continuous water flow therethrough from inlet 54 to at least one of the outlets at respective valves 44 and 50 at high boat speed to minimize deadhead pressure and boat drag. The outlet provided by check valve 44 opens in response to a first differential pressure thereacross between main cooling system pressure and water pickup pressure. The outlet provided by relief valve 50 opens in response to a second differential pressure thereacross between water intake pressure and ambient. The noted second differential pressure is greater than the noted first differential pressure. Spring 72 closes relief valve 50 and has a given relief threshold bias determining the amount of the noted second differential pressure required to open the relief valve.

Water pickup 36 is provided by a tube 106, FIGS. 1–4, slicing out a core of water along the underside of boat hull 108. Tube 106 extends forwardly longitudinally along the underside of hull 108 and slices out the core of water with minimal turbulence. The above-noted continuous flow of water through control valve 38 together with the noted slicing of a core of water minimizes the creation of a plume of water of given area in front of pickup 36, which water in such plume area must otherwise be re-accelerated. The noted combination provided by the present invention significantly minimizes the reduction in top end boat speed otherwise resulting from the addition of a supplemental water pickup.

Tube 106 has a forward leading inlet 110 slanted sharply rearwardly and downwardly to shed weeds and debris. A flange 112 is welded to tube 106 and mounts the tube to the underside of hull 108 at screws such as 114, 116. A wire 118 is welded to flange 112 at forward leading inlet 110 of tube 106 and slants sharply rearwardly and downwardly therealong to improve non-clogging of inlet 110. In a possible alternate embodiment, screen 120 may also be provided over the inlet. Tube 106 extends rearwardly to the interface 122 of hull 108 and rear transom 16, and then extends further rearwardly beyond interface 122 and has a rearward section 124 curving gently upwardly and rearwardly. Rearward section 124 of tube 106 is spaced rearwardly of transom 16 and extends along an angle relative to vertical which is greater than the angle of transom 16 relative to vertical. Flange 112 has a rearward section 126 extending rearwardly beyond interface 122 and supporting rearward section 124 of tube 106.

It is recognized that various equivalents, alternatives and modifications are possible within the scope of the appended claims.

I claim:

1. A supplemental marine cooling system for a marine engine having a main cooling system including gearcase water inlets supplying cooling water to said engine, said supplemental cooling system comprising a water pickup mounted to a boat for supplying supplemental cooling water to said main cooling system, a flow control valve between said main cooling system and said water pickup and including a check valve having an upstream side communicating with said water pickup, and a downstream side communicating with said main cooling system, said check valve supplying supplemental cooling water therethrough from said water pickup to said main cooling system to provide additional cooling for said engine when main cooling system water pressure on said downstream side of said check valve is less than supplemental cooling system water pressure on said upstream side of said check valve, said check valve blocking supplemental water flow therethrough from said water pickup to said main cooling system when main cooling system water pressure on said downstream side of said check valve is greater than supplemental cooling system water pressure on said upstream side of said check valve, wherein said control valve further comprises a relief valve between said check valve and said water pickup and discharging excess supplemental cooling water from said water pickup when said check valve is blocking water flow therethrough and supplemental cooling system water pressure is above a given relief threshold, said relief valve having a closed condition when said supplemental cooling system water pressure is below said given relief threshold, and having an open condition when said supplemental cooling system water pressure is above said given relief threshold, said relief valve in said open condition diverting supplemental cooling water therethrough and away from said check valve, said relief valve in said closed condition blocking supplemental cooling water flow therethrough and diverting supplemental cooling water to said check valve.

2. The invention according to claim 1 wherein said relief valve is a spring loaded member.

3. The invention according to claim 2 comprising a user adjustable loading mechanism changing the bias of said spring loaded member to vary said relief threshold, to in turn vary boat drag, the lower the relief threshold, the lower the boat drag.

4. The invention according to claim 1 wherein said flow control valve comprises a housing having a first passage leading to a chamber, said first passage receiving water from said water pickup, a second passage having said check valve therein and leading from said chamber and supplying supplemental cooling water to said main cooling system, and a third passage having said relief valve therein and leading from said chamber and supplying excess supplemental cooling water to a discharge port.

5. The invention according to claim 4 wherein said third passage extends along a given axis from said chamber and has an entrance port at said chamber, and an exit port providing said discharge port, a plunger axially reciprocal in said third passage and having an open position opening said entrance port, and a closed position closing said entrance port, a biasing member axially biasing said plunger to said closed position, wherein said plunger axially moves to said open position when the differential pressure between said chamber and said discharge port across said plunger at said entrance port overcomes the bias of said biasing member.

6. The invention according to claim 5 wherein said plunger has a plunger head engaging said entrance port in said closed position, and wherein said biasing member comprises a helical compression spring encircling said plunger and bearing against said plunger head.

7. The invention according to claim 6 wherein said housing includes a threaded adjustment member in said third passage and axially spaced from said plunger head, wherein said spring bears between said adjustment member and said plunger head, said adjustment member being threadingly movable by the user axially toward and away from said entrance port to adjust the bias of said spring to adjust said relief threshold to vary the amount of differential pressure required to axially move said plunger to said open condition to permit water flow from said chamber through said third passage to said discharge port.

8. The invention according to claim 6 wherein said plunger includes guide structure extending axially from said plunger head through said entrance port in each of said open and closed positions of said plunger, said guide structure comprising a plurality of radial struts defining flow channels therebetween, such that when said plunger is in said open position, water flows from said chamber through said channels through said entrance port and into said third passage, and such that as said plunger moves between said open and closed positions, said struts slide axially along and through said entrance port and guide said reciprocal movement of said plunger.

9. The invention according to claim 8 wherein said guide structure has an X-shape having four said struts defining quadrants therebetween providing four said channels.

10. The invention according to claim 5 wherein said third passage has a side wall extending parallel to said axis and spaced laterally outwardly of said plunger by an annular gap therebetween, and wherein said discharge port is in said sidewall.

11. The invention according to claim 1 wherein said check valve is a duck-bill valve.

12. A supplemental marine cooling system for a marine engine having a main cooling system including gearcase water inlets supplying cooling water to said engine, said supplemental cooling system comprising a water pickup mounted to a boat for supplying supplemental cooling water to said main cooling system, a continuous flow control valve having an inlet from said water pick-up, a first outlet to said main cooling system, and a second bypass relief outlet, said valve providing continuous water flow therethrough from said inlet to at least one of said outlets at high boat speed to minimize dead-head pressure and boat drag.

13. The invention according to claim 12 wherein said first outlet opens in response to a first differential pressure thereacross, and said second outlet opens in response to a second differential pressure thereacross, wherein said second differential pressure is greater than said first differential pressure.

14. The invention according to claim 13 comprising a biasing member closing said second outlet and having a given relief threshold bias determining the amount of said second differential pressure required to open said second outlet.

15. The invention according to claim 12 wherein said first outlet opens in response to a first differential pressure thereacross between main cooling system pressure and water pickup pressure, and said second outlet opens in response to a second differential pressure thereacross between water intake pressure and ambient.

16. The invention according to claim 12 wherein said water pickup comprises a tube slicing out a core of water from the underside of said hull with minimum drag and turbulence and supplying the water to said continuous flow control valve.

17. A remote mounted water pickup for a marine engine cooling system on a boat having a lower hull and a rear transom, comprising a tube slicing out a core of water along the underside of said hull with minimum drag, wherein said tube extends forwardly longitudinally along the underside of said hull and slices out said core with minimal turbulence, and wherein said tube has a forward leading inlet slanted sharply rearwardly and downwardly.

18. The invention according to claim 17 comprising a wire at said forward leading inlet and slanted sharply rearwardly and downwardly therealong.

19. The invention according to claim 17 wherein said tube extends rearwardly to the interface of said hull and said transom.

20. The invention according to claim 19 wherein said tube extends rearwardly beyond said interface of said hull and said transom and has a rearward section curving gently upwardly and rearwardly.

21. The invention according to claim 20 wherein said rearward section of said tube is spaced rearwardly of said transom and extends along an angle relative to vertical which is greater than the angle of said transom relative to vertical.

22. A remote mounted water pickup for a marine engine cooling system on a boat having a lower hull and a rear transom, comprising a tube slicing out a core of water along the underside of said hull with minimum drag, wherein said tube extends forwardly longitudinally along the underside of said hull and slices out said core with minimal turbulence, wherein said tube extends rearwardly to the interface of said hull and said transom, wherein said tube extends rearwardly beyond said interface of said hull and said transom and has a rearward section curving gently upwardly and rearwardly, and wherein said water pickup comprises a flange mounting said tube to said underside of said hull, said flange having a rearward section extending rearwardly beyond said interface and supporting said rearward section of said tube.

23. A supplemental remote mounted marine engine cooling system on a boat having a lower hull and a rear transom, comprising a water pickup tube slicing out a core of water from the underside of said hull with minimum drag and turbulence and supplying the water to a flow control valve controlling flow to said engine, wherein said flow control valve is on said transom.

24. The invention according to claim 23 wherein said water pickup tube receives incoming water along the underside of said hull, and including a connection extending upwardly along said transom to said flow control valve.

25. A supplemental remote mounted marine engine cooling system on a boat having a lower hull and a rear transom, comprising a water pickup tube slicing out a core of water from the underside of said hull with minimum drag and turbulence and supplying the water to a flow control valve controlling flow to said engine, wherein said water pickup tube has a forward portion extending along the underside of said hull, and a rearward portion gently curved around the interface of said hull and said transom and extending upwardly and rearwardly therefrom.

* * * * *